United States Patent [19]

Hayakawa et al.

[11] Patent Number: 4,797,068

[45] Date of Patent: Jan. 10, 1989

[54] VACUUM EVACUATION SYSTEM

[75] Inventors: Tadashi Hayakawa; Kazuaki Shiinoki, both of Ebina; Sinji Mitsuhashi, Yokohama; Kotaro Naya, Ebina, all of Japan

[73] Assignee: Hitachi, Ltd., Tokyo, Japan

[21] Appl. No.: 58,821

[22] Filed: Jun. 5, 1987

[30] Foreign Application Priority Data

Jun. 12, 1986 [JP] Japan ..... 61-134837

[51] Int. Cl.[4] ..... F04B 37/14; F04B 23/08

[52] U.S. Cl. ..... 417/201; 417/205; 418/201

[58] Field of Search ..... 417/203, 205, 423 C; 415/90; 418/201

[56] References Cited

U.S. PATENT DOCUMENTS

| | | | |
|---|---|---|---|
| 1,927,799 | 9/1933 | Mann | 417/203 |
| 2,926,835 | 3/1960 | Lorenz | 417/205 X |
| 3,066,849 | 12/1962 | Beams | 417/423 C |
| 3,104,802 | 9/1963 | Elkberg | 417/20 S X |
| 3,112,869 | 12/1963 | Aschoff | 418/201 X |
| 3,924,962 | 12/1975 | Maurice | 415/90 |
| 4,090,815 | 5/1978 | Nakamura | 417/203 |
| 4,655,678 | 4/1987 | Miki | 419/90 X |

FOREIGN PATENT DOCUMENTS

| | | | |
|---|---|---|---|
| 955352 | 1/1957 | Fed. Rep. of Germany | 417/205 |
| 235900 | 6/1969 | U.S.S.R. | 417/203 |

*Primary Examiner*—William L. Freeh

*Attorney, Agent, or Firm*—Antonelli, Terry & Wands

[57] ABSTRACT

A vacuum evacuation system comprising a non-positive displacement type vacuum pump called molecular pump which obtains high pumping speed in a high vacuum range, and an oil-free, positive displacement type vacuum pump called screw vacuum pump. The non-positive displacement type vacuum pump and the positive displacement type vacuum pump are connected to each other such that the non-positive displacement type vacuum pump is located on a high vacuum side and the positive displacement type vacuum pump is located on a low pressure or atmospheric side, to thereby prevent oil from being penetrated into a system to be evacuated.

9 Claims, 3 Drawing Sheets

VACUUM EVACUATION SYSTEM

BACKGROUND OF THE INVENTION

The present invention relates to a vacuum evacuation system for producing high vacuum in a system to be evacuated and, more particularly, to a vacuum evacuation system suitable for semiconductor manufacturing apparatuses.

As disclosed, for example, in "Shinkuu Gijutu Jitsumu Tokuhon (Vacuum Technique Practice Reader)" written by Katsuya Nakayama, published on Oct. 25, 1967, Ohm-Sha, pages 21–22, the conventional vacuum evacuation system comprises a combination of a mechanical booster provided on a vacuum side, which is a vacuum pump of Roots blower type, and an oil-sealed rotary vacuum pump provided on an atmospheric side. In addition, U.S. Pat. No. 3,969,039 discloses another conventional vacuum evacuation system in which axial flow turbomolecular pumping means, centrifugal compressor means and fluid diode pumping means are arranged on a single shaft in side-by-side relation so as to be connected to each other.

The former system has such problems that, since a working chamber of the oil-sealed rotary vacuum pump is filled with oil, back-diffusion of the oil to the vacuum-side occurs, and since the pumping speed of the mechanical booster decreases from about $10^{-2}$ Torr, the system is unsuitable for an evacuation system for semiconductor manufacturing apparatuses and the like, which requires particularly high cleanness and high pumping speed in high vacuum.

The latter system has such a problem that, since various kinds of pumping means are connected to each other by the single shaft, it is impossible to drive the pumping means at revolution speeds or rotational speeds respectively suitable for the pumping means.

OBJECTS AND SUMMARY OF THE INVENTION

It is an object of the present invention to provide a vacuum evacuation system which can prevent oil from penetrating into a working chamber so that there would be no fear of back-diffusion of the oil to a system to be evacuated.

It is another object of the invention to provide a vacuum evacuation system in which each pumping means can be driven at its suitable revolution speed or rotational speed, while preventing oil from penetrating into a working chamber and a system to be evacuated.

In order to achieve the above objects, a vacuum evacuation system according to the invention is so arranged as to comprise:

a first vacuum pump having a rotary component, a suction port and an exhaust port, in which gas molecules are caused to collide with the rotary component rotating at high speed so as to be given a momentum in a direction of linear velocity of the rotary component so that a gas flow is produced in a given direction;

a second vacuum pump including a casing provided with a suction port and an exhaust port, and a pair of male and female screw rotors supported within the casing with a slight gap maintained between the casing and the screw rotors, the pair of male and female screw rotors being rotated with a slight gap maintained therebetween to produce a differential pressure between the suction and exhaust ports provided in the casing;

piping means for connecting the exhaust port of the first vacuum pump to the suction port of the second vacuum pump; and the suction port of the first vacuum pump being disposed on a vacuum side, and the exhaust port of the second vacuum pump being disposed on an atmospheric side.

The above-described objects are achieved by a combination of a pump of the type which mechanically blows off gas molecules, called a molecular pump, to obtain high pumping speed in a high vacuum range, and an oil-free screw vacuum pump having no oil within a working chamber, which is employed as an auxiliary pump for compensating for the molecular pump cannot be actuated when pressure at an exhaust port of the molecular pump which is equal to or above the atmospheric pressure.

The auxiliary pump of the above-described combined arrangement, that is, the second vacuum pump is of the type in which a pair of male and female screw rotors are supported within a casing by respective bearings with a slight gap maintained between the inner surface of the casing and the screw rotors, and the pair of screw rotors are rotated in synchronized relation by timing gears with a slight gap maintained between the screw rotors, to produce a differential pressure between a suction and an exhaust port provided in the casing. It is unnecessary to lubricate the working chamber formed by the screw rotors and the casing. In addition, lubricating oil supplied to the bearings supporting the respective screw rotors is prevented from penetrating into the working chamber by respective seal assemblies each comprised of a labyrinth seal, a screw type seal, a floating labyrinth seal and the like. Thus, the second vacuum pump is of an oil-free construction.

For the reasons described above, the combination of the second vacuum pump with the molecular pump can provide a vacuum evacuation system which is clean and has high pumping speed in a high vacuum range.

DETAILED DESCRIPTION

Figure 1:
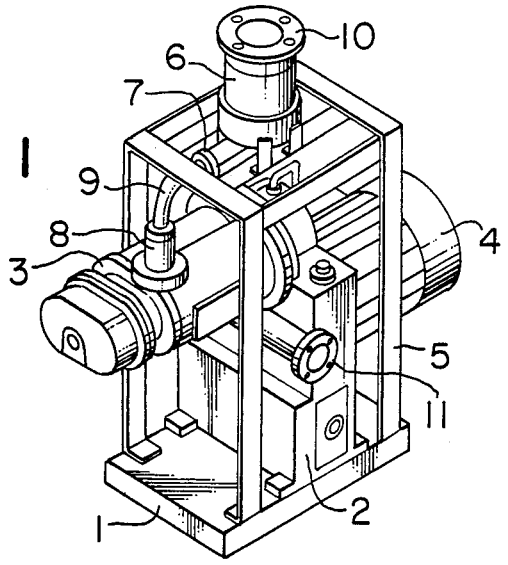
FIG. 1 is a perspective view showing a vacuum evacuation system in accordance with an embodiment of the invention.

The vacuum evacuation system shown in FIG. 1 comprises a base 1 and a gear case 2 fixedly mounted thereon. Attached in a cantilevered manner to the respective sides of the gear case 2 are a screw vacuum pump element 3 forming a second vacuum pump, and a motor 4 for driving the screw vacuum pump element 3, to constitute an atmospheric-side pump. A frame 5 is mounted on the base 1 so as to straddle the atmospheric-side pump. A molecular pump 6 forming a first vacuum pump is mounted to an upper portion of the frame 5, to constitute a vacuum-side pump.

Piping 9 is provided for connecting an exhaust port 7 of the molecular pump 6 to a suction port 8 of the screw vacuum pump 3.

The molecular pump 6, i.e., the vacuum-side pump and the screw vacuum pump 3, i.e., the atmospheric-side pump are supplied with electric power from an electric power supply device (not shown) and are operated by a control panel (not shown).

The illustrated vacuum evacuation system has a suction port which is a suction port 10 of the molecular pump 6, and an exhaust port which is an exhaust port 11 of the screw vacuum pump 3.

The molecular pump 6 forming the first vacuum pump will first be described in detail with reference to FIG. 2.

Figure 2:
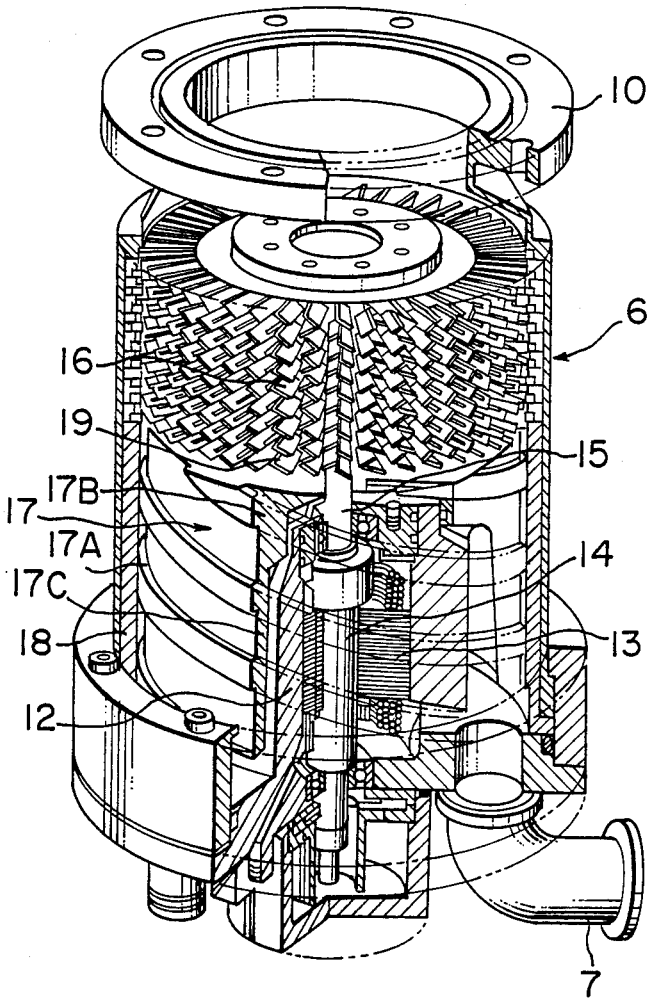
FIG. 2 is a perspective view showing an internal construction of a molecular pump incorporated in the system illustrated in FIG. 1.

As shown in FIG. 2, a pump drive motor comprises a motor stator 13 fixedly mounted vertically within a housing 12. Within the motor stator 13, a motor rotor 14 and a rotary shaft 15 fitted thereinto are supported vertically.

The rotary shaft 15 has an upper portion thereof extending from the housing 12. A multiplicity of rotor blades 16 are fixedly secured to the peripheral surface of an upper section of the extending portion of the rotary shaft 15. A rotor 17 is fixedly mounted between the rotor blade assembly and the housing 12 so as to cover or surround the same. The rotor 17 is comprised of an upper end wall 17B and an annular portion 17C connected thereto. A helical groove 17A of a trapezoidal cross-section is formed in the outer peripheral surface of the annular portion 17C.

A stator 18 forms an outer case of the molecular pump 6, and a slight gap is maintained between the stator 18 and the outer peripheral surface of the rotor 17. Inside an upper portion of the stator 18, stator blades 19 are fixedly secured at positions overlapping the rotor blades 16.

As electric current is caused to pass through the coils of the stator 13 from the electric power supply device (not shown), a rotary component comprised of the rotary shaft 15, motor rotor 14, rotor blades 16 and rotor 17 is rotated at high speed so that gas molecules introduced through the suction port 10 are mechanically blown off by the rotor blades 16 and the trapezoidal helical groove 17A and are discharged through the exhaust port 7, to thereby produce a pumping action. However, if the pressure on the exhaust side is high, the molecular pump 6 cannot be operated, because extremely high power is required. The molecular pump 6 can be operated if the pressure at the exhaust port 7 is brought to a level equal to or less than 2 Torr.

Figure 3:
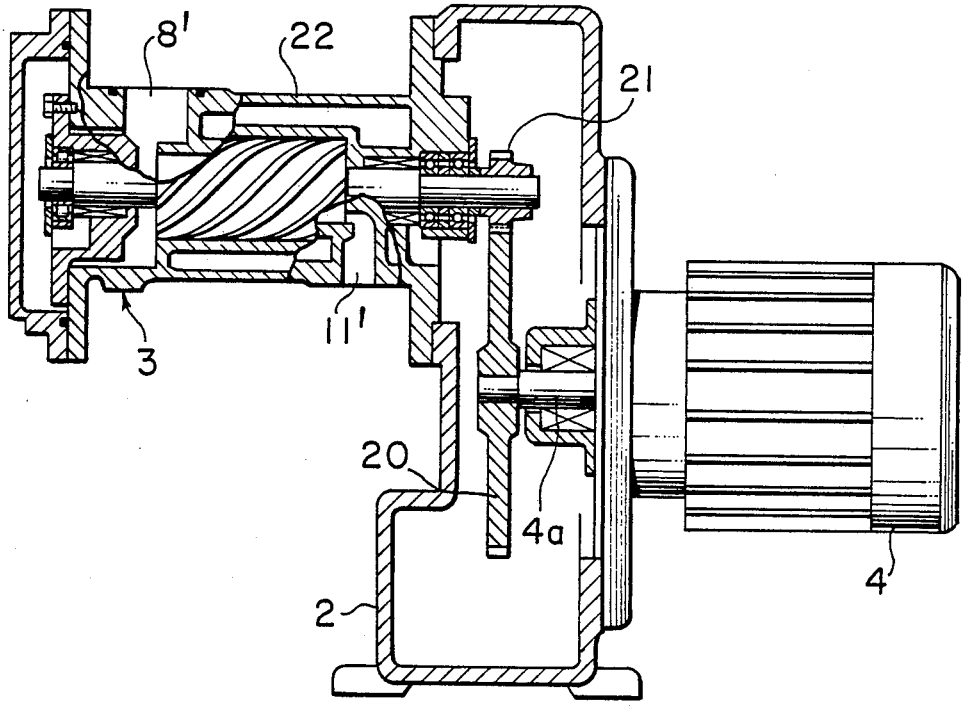
FIG. 3 is a longitudinally cross-sectional view showing a screw vacuum pump apparatus incorporated in the system illustrated in FIG. 1.

The screw vacuum pump forming the second vacuum pump (auxiliary pump) will next be described with reference to FIGS. 3 through 5.

A speed increasing gear 20 is disposed within the gear case 2 and is fixedly mounted on an output shaft 4*a* of the motor 4. The speed increasing gear 20 is in mesh with a male-rotor-side timing gear 21. Within a casing 22 of the screw vacuum pump element 3, a pair of male and female screw rotors 23 and 24 are supported with a slight gap maintained between an inner surface of the casing 22 and the screw rotors 23 and 24. These screw rotors 23 and 24 are in mesh with each other by means of the male-rotor-side timing gear 21 and a female-rotor-side timing gear 25 with a slight gap maintained between the screw rotors 23 and 24. As shown in FIG. 3, the casing 22 is provided with a suction port 8′ and an exhaust port 11′.

Figure 4:
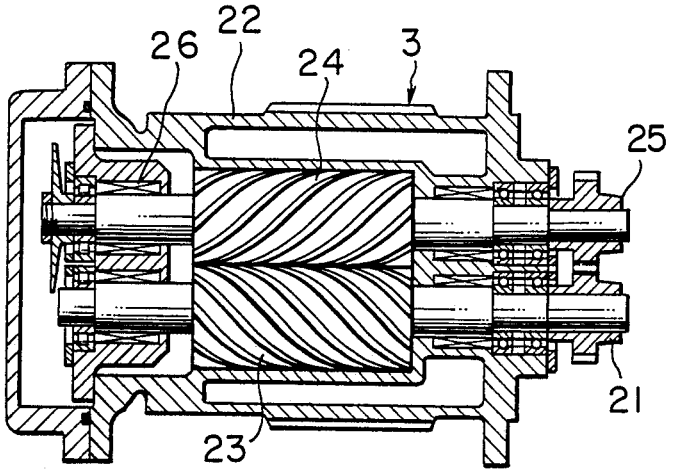
FIG. 4 is a longitudinally cross-sectional view showing a screw vacuum pump element of the apparatus illustrated in FIG. 3.
Figure 5:
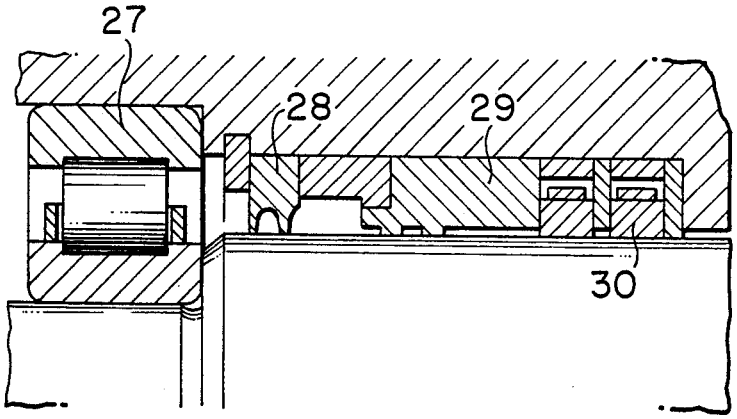
FIG. 5 is an enlarged cross-sectional view of a seal assembly illustrated in FIG. 4.

A seal assembly 26 illustrated in FIG. 4 is provided for each of shaft portions of the respective male and female screw rotors 23 and 24. As shown in detail in FIG. 5, the seal assembly 26 is comprised of a bearing 27, a labyrinth seal 28, a screw type seal 29 and a floating labyrinth seal 30.

Rotation of the motor 4 is increased by the speed increasing gear 20 to rotate the pair of male and female screw rotors 23 and 24. As the screw rotors are rotated, gas drawn through the suction port 8′ is delivered toward the exhaust side (right side in FIG. 3), while being maintained confined within a closed chamber formed by the helical grooves of the respective screw rotors and the inner surface of the casing 22. The delivered gas is discharged through the exhaust port 11′.

The volume of the above-mentioned closed chamber at completion of the suction is different from the volume of the closed chamber just before the discharge, and the latter volume is made smaller than the former volume by an amount corresponding to the compression ratio, so that a pumping action is produced. The bearings 27 respectively supporting the screw rotors are lubricated forcibly or in a splashing manner through lubricating piping (not shown) by an oil supply device (not shown). However, the triple seals as shown in FIG. 5 prevent the oil from penetrating into the working chamber.

The operation of the entire vacuum evacuation system in accordance with the embodiment of the invention will next be described with reference to FIG. 1.

In a case where the illustrated vacuum evacuation system is operated from the point of time the pressure on the suction side of the system, that is, the pressure at the suction port 10 of the molecular pump 6 is higher than a predetermined pressure, the screw vacuum pump 3 is first operated, and the molecular pump is subsequently operated after the pressure at the exhaust port 7 of the molecular pump 6 is reduced to a level equal to or less than a predetermined pressure (about 2 Torr).

If the system is operated to cause the gas to flow when the pressure at the exhaust port 7 of the molecular pump 6 is equal to or less than the predetermined pressure, both pumps are operated. The screw vacuum pump 3 compresses the gas of the flow rate taken in by the molecular pump 6, from the pressure at the exhaust port 7 to the atmospheric pressure, and discharges the compressed gas through the exhaust port 11.

Control of the operation of the pumps is automatically effected by pressure sensors and a control device (both not shown).

According to the illustrated embodiment, it is possible to cause the gas to flow at high flow rate in the high vacuum range, as compared with the conventional mechanical booster (the ultimate pressure is on the order of $10^{-4}$ Torr, and the design pumping speed is obtained in the vicinity of $10^{-2}$ to 1 Torr), because the illustrated embodiment is so arranged as to comprise the combination of the oil-free screw vacuum pump 3 and the molecular pump 6 (the ultimate pressure is $10^{-10}$ Torr, and the flow rate is on the order of 200 liter/sec. at $10^{-3}$ to $10^{-10}$ Torr).

Moreover, both the molecular pump 6 on the vacuum side and the screw vacuum pump element 3 on the atmospheric side are of a construction in which the working chamber has therein no oil and, therefore, there is provided a vacuum evacuation system which is clean and which is extremely low in back-diffusion of the oil to the vacuum side. This avoids the necessity of a foreline trap for oil adsorption which has conventionally been used to even slightly relieve the back-diffusion of the oil from the oil-sealed rotary vacuum pump.

Furthermore, many of the gases employed in the semiconductor manufacturing apparatuses have such nature as to immediately degrade oil. Accordingly, it has been necessary for the conventional oil-sealed rotary vacuum pump to waste great labor in maintenance of the oil. In the illustrated embodiment, however, since there is almost no contact between the gas and the oil, it is made possible to considerably reduce labor wasted in the maintenance.

What is claimed is:

1. A vacuum evacuation system comprising:

a first vacuum pump having a rotary component which is adapted to rotate at high speeds to produce a linear velocity and against which gas molecules are caused to strike, thus giving momentum of said rotary component in a direction of the linear velocity of the rotary component to produce a gas flow in a given direction;

a second vacuum pump having a casing provided with suction and exhaust ports between which a gas flow passage is defined and in which a pair of male and female screw rotors are supported with a minute gap between said screw rotors and said casing, the inner surface of said casing and said pair of male and femal screw rotors defining a working chamber in which said screw rotors rotate with a minute gap maintained therebetween in the absence of sealing, cooling and lubrication liquid, within said working chamber and the gas flow passage thereby producing a differential pressure between the suction and exhaust ports provided in said casing;

means connecting said exhaust port of said first vacuum pump to said suction port of said second vacuum pump; and said suction port of said first vacuum pump being disposed on a vacuum side, and said exhaust port of said second vacuum pump being disposed on an atmospheric side.

2. A vacuum evacuation system as defined in claim 1, wherein said first vacuum pump comprises an outer case, a rotary shaft disposed within said outer case and supported rotatably, a plurality of rotor blades fixedly mounted on said rotary shaft, and a rotor fixedly mounted on said rotary shaft and having an outer peripheral surface formed with a helical groove.

3. A vacuum evacuation system as defined in claim 1, wherein said first vacuum pump comprises a stationary outer case, a motor disposed within said outer case and having a rotor, a rotary shaft connected to said rotor of said motor, a plurality of rotor blade cascades fixedly mounted on said rotary shaft, and a helically grooved rotor fixedly mounted on said rotary shaft and having an outer peripheral surface formed with a helical groove, said helically grooved rotor being located downstream of said rotor blade cascades.

4. A vacuum evacuation system as defined in claim 3, wherein said motor has a housing, and said helically grooved rotor is in the form of an annulus having an upper end wall to surround said housing of said motor.

5. A vacuum evacuation system as defined in claim 4, wherein said rotary shaft is arranged vertically, and said helically grooved rotor is connected to said rotary shaft at said upper end wall.

6. A vacuum evacuation system comprising:

first vacuum pump means having a rotor blade stage including stator blades secured to an outer case and rotor blades arranged in facing relationship with said stator blades, against which respective blades gas molecules are caused to strike to produce a gas flow in a downstream direction, and a screw pump stage including a helically grooved rotor formed at its outer peripheral surface facing the outer case with a helical groove, said helical groove serving to deliver the gas from said rotor blade stage in the downstream direction;

second vacuum pump means having a casing provided with suction and exhaust ports between which a gas flow passage is defined and a pair of screw rotors, each having a plurality of helical irregularities at its outer peripheral surface and rotatably received within said casing in meshing relation with each other, said pair of screw rotors and the inner surface of said casing defining a working chamber in which said pair of screw rotors rotated in the absence of sealing, cooling and lubrication liquid within said working chamber and the gas flow passage and sealing means disposed between said casing and the respective shaft portions of said pair of screw rotors; and drive means for driving said first and second vacuum pump means.

7. A vacuum evacuation system according to claim 6, wherein said drive means includes first drive means fixedly secured to said outer case for driving said first vacuum pump means, and second drive means for driving said screw rotors of said second vacuum pump means, and wherein said helically grooved rotor of said first vacuum pump means is in the form of an annulus having an upper end wall, the annular portion surrounding said first drive means.

8. A vacuum evacuation system as defined in claim 7, wherein said helically grooved rotor is fixedly mounted to said first drive means at said upper end wall.

9. A vacuum evacuation system comprising:

non-positive displacement-type vacuum pump means having rotor blade cascades including stator blades and rotor blades disposed in facing relation to said stator blades, for providing a gas flow in a downstream direction in a gas flow passage by causing gas molecules to strike against the rotating rotor blades, and screw pump means having a helically grooved rotor formed at its outer pheripheral surface with a helical groove, said helical groove serving to deliver the gas molecules from said rotor blade cascades;

positive displacement-type twin screw vacuum pump means including a casing provided with suction and exhaust ports between which a gas flow pasage is defined and having an inlet in communication with said outlet of said non-positive displacement type vacuum pump means, a pair of screw rotors having meshing helical ridges and grooves at the outer peripheral surfaces thereof and rotatably received within said casing, said pair of screw rotors and the inner surface of said casing defining a working chamber in which said pair of screw rotors rotate in the absence of sealing, cooling and lubrication liquid within said working chamber and the gas flow passage, and sealing means disposed between said casing and the respective shaft portions of said screw rotors; and drive means for driving said non-positive displacement-type vacuum pump means and said positive displacement-type vacuum pump means.

* * * * *